US011192757B2

(12) United States Patent
Frossard et al.

(10) Patent No.: US 11,192,757 B2
(45) Date of Patent: Dec. 7, 2021

(54) METHOD AND SYSTEM FOR ENSURING SOCIAL DISTANCING ON AN ESCALATOR OR TRAVELLATOR

(71) Applicant: TECHDAYAFTER INC., Sherwood Park (CA)

(72) Inventors: Regis Frossard, Sherwood Park (CA); Benjamin Le Coent, Poissy (FR)

(73) Assignee: Techdayafter, Inc., Sherwood Park (CA)

( * ) Notice: Subject to any disclaimer, the term of this patent is extended or adjusted under 35 U.S.C. 154(b) by 0 days.

(21) Appl. No.: 17/171,309

(22) Filed: Feb. 9, 2021

(65) Prior Publication Data

US 2021/0347611 A1 Nov. 11, 2021

Related U.S. Application Data

(60) Provisional application No. 63/069,992, filed on Aug. 25, 2020.

(30) Foreign Application Priority Data

May 6, 2020 (WO) ..... PCT/CA2020/050602

(51) Int. Cl.

| | |
|---|---|
| ***B66B 27/00*** | (2006.01) |
| ***B66B 29/00*** | (2006.01) |
| ***B66B 25/00*** | (2006.01) |
| ***B66B 29/08*** | (2006.01) |

(52) U.S. Cl.

CPC ..... *B66B 27/00* (2013.01); *B66B 25/00* (2013.01); *B66B 25/003* (2013.01); *B66B 29/00* (2013.01); *B66B 29/08* (2013.01)

(58) Field of Classification Search

CPC ..... B66B 27/00; B66B 29/00; B66B 25/00; B66B 25/003; B66B 29/005; B66B 29/08; B66B 2201/00

USPC ..... 198/322, 324

See application file for complete search history.

(56) References Cited

U.S. PATENT DOCUMENTS

| | | | | |
|---|---|---|---|---|
| 5,782,330 | A * | 7/1998 | Mehlert | B66B 27/00 198/322 |
| 6,334,522 | B2 * | 1/2002 | Haruta | B66B 25/00 198/322 |
| 7,775,359 | B2 * | 8/2010 | Maeda | B65D 85/672 206/391 |
| 8,141,693 | B2 * | 3/2012 | Sansevero | B66B 25/006 198/324 |
| 10,351,392 | B1 * | 7/2019 | Gurvich | B66B 29/00 |
| 11,024,116 | B1 * | 6/2021 | Hoehne | G07F 17/3244 |
| 2005/0121288 | A1 * | 6/2005 | Blondiau | B66B 25/00 198/322 |

(Continued)

FOREIGN PATENT DOCUMENTS

| | | | | |
|---|---|---|---|---|
| CN | 105829236 | * | 8/2016 | B66B 25/00 |
| CN | 112723124 | * | 4/2021 | B66B 21/02 |
| WO | 2021124098 | * | 6/2021 | B66B 27/00 |

*Primary Examiner* — James R Bidwell

(74) *Attorney, Agent, or Firm* — James A. Sheridan; Sheridan Law, LLC

(57) ABSTRACT

A method and system is discussed for detecting distances between passengers walking onto escalators and moving sidewalks or travellators and for providing alerts to the passengers when minimum social distancing between the passengers is not being maintained.

20 Claims, 5 Drawing Sheets

(56) References Cited

U.S. PATENT DOCUMENTS

| | | | | |
|---|---|---|---|---|
| 2014/0076686 | A1* | 3/2014 | De Coi | B66B 25/00 198/322 |
| 2021/0011443 | A1* | 1/2021 | Mcnamara | G05B 19/042 |
| 2021/0271217 | A1* | 9/2021 | Greschler | G05B 19/042 |

* cited by examiner (*) d = social distance, v = d/t and v = 0.5m/s

METHOD AND SYSTEM FOR ENSURING SOCIAL DISTANCING ON AN ESCALATOR OR TRAVELLATOR

CROSS-REFERENCE TO RELATED APPLICATIONS

This application claims priority of International patent application no. PCT/CA2020/050602 filed 6 May 2020 and of U.S. provisional patent application Ser. No. 63/069,992 filed Aug. 25, 2020, both of which are incorporated by reference into this application in their entirety.

TECHNICAL FIELD

The present disclosure is related to the field of ensuring social distancing of passengers on escalators and moving sidewalks or travellators, in particular, methods and systems for detecting the distance between passengers on escalators and moving sidewalks or travellators and alerting passengers when social distancing requirements are not being met.

BACKGROUND

Due to the world-wide threat of virus outbreak, such as Covid19, people maintaining a fixed physical or social distance from one another will become a new standard for health, safety and hygiene purposes. People are requested now, either by law, rule or recommendation, to respect and maintain a minimum social distance between each other, which, for example can range between 1 to 2 metres depending on the country or region therein. Not respecting social distances can potentially result in increasing the transmission of infection of such viruses.

It is, therefore, desirable to provide a method and system that can detect the physical distances between passengers on escalators and moving sidewalks or travellators and can alert passengers when minimum social distancing is not being maintained.

SUMMARY

In some embodiments, a method and system can be provided for detecting distances between passengers walking onto escalators and moving sidewalks or travellators and for providing alerts to the passengers when minimum social distancing between the passengers is not being maintained.

Broadly stated, in some embodiments, a method can be provided for ensuring social distancing on an escalator or travellator between a first passenger and a second passenger, the method comprising: detecting when the first passenger passes by a first motion detector disposed at an entrance of the escalator or travellator; calculating a time period it takes the first passenger to travel a predetermined distance required for social distancing on the escalator or travellator based on a velocity the escalator or travellator operates at, wherein the time period starts when the first passenger passes by the first motion detector; detecting when the second passenger passes by the first motion detector; and alerting the second passenger to stop and wait if the second passenger passes by the first motion detector before the time period expires.

Broadly stated, in some embodiments, the method can further comprise alerting the second passenger with one or both of an audible alarm and a visual alarm.

Broadly stated, in some embodiments, the method can further comprise alerting the second passenger when it is safe to proceed onto the escalator or travellator.

Broadly stated, in some embodiments, the method can further comprise alerting the second passenger when the first passenger is at least the predetermined distance required for social distancing away from the second passenger.

Broadly stated, in some embodiments, the method can further comprise alerting the first passenger when it is safe to proceed onto the escalator or travellator.

Broadly stated, in some embodiments, the method can further comprise: detecting when the first passenger passes by a second motion detector, wherein the second motion detector is disposed from the first motion detector by at least the predetermined distance required for social distancing; and alerting the second passenger to stop and wait if the second passenger passes by the first motion detector before the first passenger passes by the second motion detector.

Broadly stated, in some embodiments, a system can be provided for ensuring social distancing on an escalator or travellator between a first passenger and a second passenger, the system comprising: means for detecting when the first passenger passes by a first motion detector disposed at an entrance of the escalator or travellator; means for calculating a time period it takes the first passenger to travel a predetermined distance required for social distancing on the escalator or travellator based on a velocity the escalator or travellator operates at, wherein the time period starts when the first passenger passes by the first motion detector; means for detecting when the second passenger passes by the first motion detector; and means for alerting the second passenger if the second passenger passes by the first motion detector before the time period expires.

Broadly stated, in some embodiments, the system can further comprise means for alerting the second passenger with one or both of an audible alarm and a visual alarm.

Broadly stated, in some embodiments, the system can further comprise means for alerting the second passenger when it is safe to proceed onto the escalator or travellator.

Broadly stated, in some embodiments, the system can further comprise means for alerting the first passenger when it is safe to proceed onto the escalator or travellator.

Broadly stated, in some embodiments, the system can further comprise: means for detecting when the first passenger passes by a second motion detector, wherein the second motion detector is disposed from the first motion detector by at least the predetermined distance required for social distancing; and means for alerting the second passenger to stop and wait if the second passenger passes by the first motion detector before the first passenger passes by the second motion detector.

DETAILED DESCRIPTION OF EMBODIMENTS

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment can also be included in other embodiments but is not necessarily included. Thus, the present technology can include a variety of combinations and/or integrations of the embodiments described herein.

Figure 1:
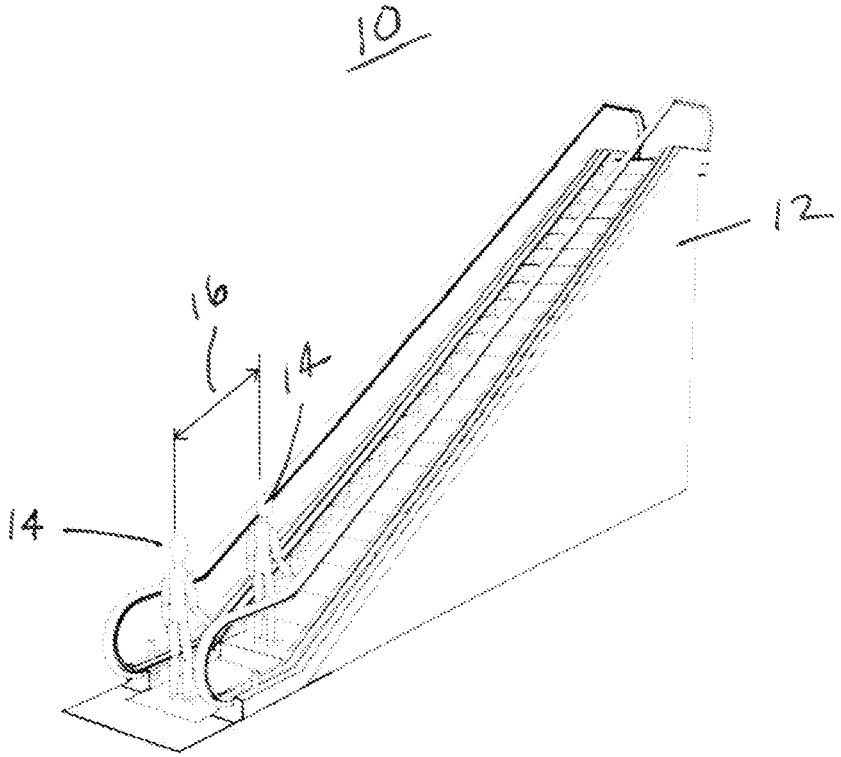
FIG. 1 is a perspective view depicting two passengers entering onto an escalator.

In some embodiments, a method and system can be provided for detecting distances between passengers walking onto escalators and moving sidewalks or travellators and for providing alerts to the passengers when minimum social distancing between the passengers is not being maintained. Referring to FIG. 1, one example of two successive passengers 14 are shown walking onto escalator 12. Social distancing requirements dictate that people maintain a minimum distance between each other as a means to preventing the spread of infections between each other, denoted as reference character 16 in FIG. 1. In many jurisdictions, distance 16 is selected as being approximately 2 metres.

Figure 2:
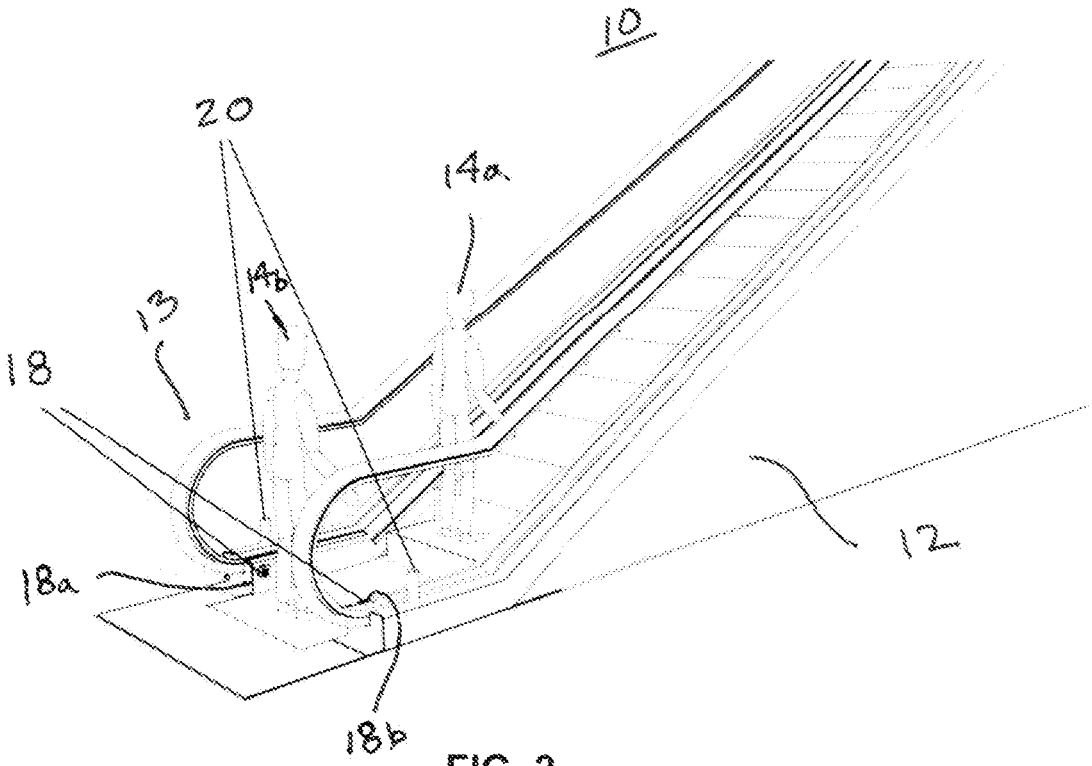
FIG. 2 is a perspective view depicting a first embodiment of a system for detecting the distance between passengers entering the escalator of FIG. 1.

Referring to FIG. 2, one embodiment of system 10 for detecting distances between passengers walking onto escalators and moving sidewalks or travellators is shown. In some embodiments, system 10 can comprise of motion detectors 18 disposed near entrance 13 of escalator 12, with complementary components 18*a* and 18*b* on opposing sides of entrance 13. Components 18*a* and 18*b* can respectively comprise of a light source and light detector, such as an infrared light source and an infrared light detector or photocell where the light source is directed towards the light detector. In some embodiments, motion detector 18 can comprise a Model E3JK photoelectric sensor system as manufactured by the Omron Corporation of Kyoto, Japan. When a person walks by motion detector 18, they can interrupt the light landing on the light detector, which can then operate as a momentary switch to create an electrical pulse signal to a microcontroller for use in system 10. After the person has walked past the motion detector, the light can then land on the light detector, returning the motion detector to its previous electrical state. In some embodiments, when first passenger 14*a* passes by motion detector 18, it can trigger system 10 to calculate the distance the first passenger travels from motion detector 18 relative second passenger 14*b* approaching escalator 12 after first passenger 14*a*. In some embodiments, system 10 can make the calculation based on the known constant speed of escalator 12 and based on the timing triggered by passengers 14*a* and 14*b* who walk past motion detector 18. If, for example, the speed of escalator 12 is 0.5 metres/second, then passenger 14*a* will travel 2 metres from motion detector 18 in 4 seconds. If passenger 14*b* walks past motion detector 18 within 4 seconds of passenger 14*a* walking past motion detector 18, that is, passenger 14*b* being less than 2 metres away from passenger 14*a*, then system 10 can activate indicator 20 to initiate a "stop" command that can comprise one or more of a vocal message, an audible alarm and a visual alarm, indicating to passenger 14*b* to stop and, thus, wait until passenger 14*a* is at least 2 metres away from passenger 14*b*. In some embodiments, the vocal message can comprise a verbal message to stop and wait; the audible alarm can comprise a loud, warning sound and the visual alarm can comprise, for example, a red light or a visual "stop" light.

In some embodiments, when the social distance requirement is respected by 14*b*, that is, passenger 14*b* passes by motion detector 18 when passenger 14*a* is at least 2 metres away, indicator 20 can activate a "go" command to indicate that it is safe for passenger 14*b* to enter escalator 12, which can comprise one or more of a vocal message, an audible alarm and a visual alarm indicating to passenger 14*b* that they can proceed onto escalator 12. In some embodiments, the vocal message can comprise a verbal message to proceed; the audible alarm can comprise a pleasing sound and the visual alarm can comprise, for example, a green light or a visual "go" light.

In some embodiments, system 10 can activate indicator 20 to initiate the "stop" command when passenger 14*a* passes by motion detector 18, which can remain activated until system 10 determines when passenger 14*a* has moved at least 2 metres away from motion detector 18 to provide an indication to passenger 14*b* to wait before entering escalator 12. In some embodiments, system 10 can calculate the time required for passenger 14*a* to move at least 2 metres away from motion detector 18 based on the speed of escalator 12. If the speed of escalator 12 is, for example, 0.5 metres/second, then system 10 can operate a timer that counts down 4 seconds of time after passenger 14*a* has passed motion detector 18. When at least 4 seconds has then passed, system 10 can activate indicator 20 to initiate the "go" command to provide an indication to passenger 14*b* that they can enter escalator 12.

Figure 3:
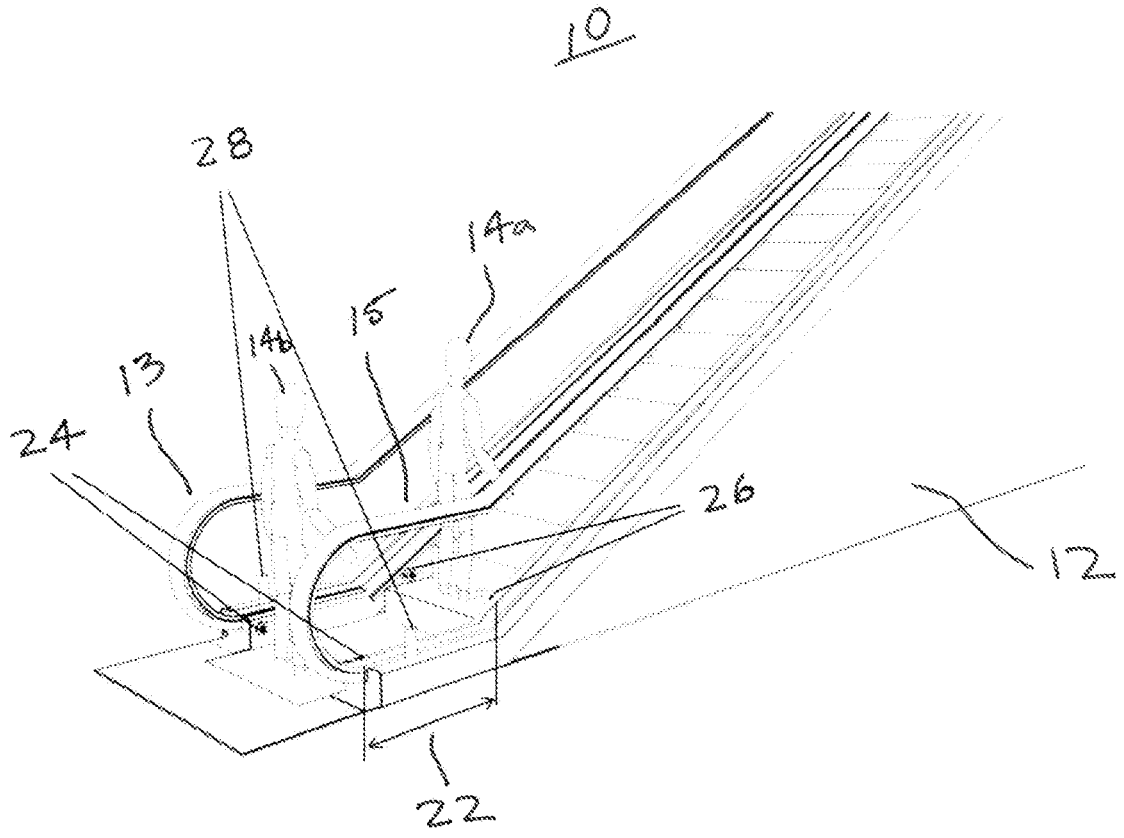
FIG. 3 is a perspective view depicting a second embodiment of a system for detecting the distance between passengers entering the escalator of FIG. 1.

In some embodiments, system 10 can comprise an alternate method to maintain social distance between passengers 14*a* and 14*b* on escalator 12, as shown in FIG. 3. In some embodiments, system 10 can comprise of a first motion detector 24 located at entrance 13 of escalator 12 and a second motion detector 26 located distance 22 away from motion detector 24, where distance 22 can be at least 2 metres. In some embodiments, one or both of motion detectors 24 and 26 can comprise of a light source and light detector, such as an infrared light source and an infrared light detector or photocell where the light source is directed towards the light detector, similar to motion detector components 18*a* and 18*b*.

When passenger 14*a* crosses motion detector 24, the controller of system 10 can notified of this event by motion detector 24. If passenger 14*b* crosses motion detector 24 before passenger 14*a* crosses by motion detector 26, system 10 can activate indicator 28 that can comprise one or more of a vocal message, an audible alarm and a visual alarm, indicating to passenger 14*b* to stop and, thus, wait until passenger 14*a* is at least 2 metres away from passenger 14*b*. In some embodiments, the vocal message can comprise a verbal message to stop and wait; the audible alarm can comprise a loud, warning sound and the visual alarm can comprise, for example, a red light or a visual "stop" light.

If passenger 14*a* crosses motion detector 26 before passenger 14*b* crosses motion detector 24, indicator 28 can activate to indicate that it is safe for passenger 14*b* to enter escalator 12, which can comprise one or more of a vocal message, an audible alarm and a visual alarm indicating to passenger 14*b* that they can proceed onto escalator 12. In some embodiments, the vocal message can comprise a verbal message to proceed; the audible alarm can comprise a pleasing sound and the visual alarm can comprise, for example, a green light or a visual "go" light.

In some embodiments, system 10 can activate indicator 28 to initiate the "stop" command when passenger 14*a* passes by motion detector 24, which can remain activated until system 10 determines when passenger 14*a* has moved past motion detector 26 to provide an indication to passenger 14*b* to wait before entering escalator 12. When passenger 14*a* has moved past motion detector 26, system 10 can activate indicator 28 to initiate the "go" command to provide an indication to passenger 14*b* that they can enter escalator 12.

Figure 4:
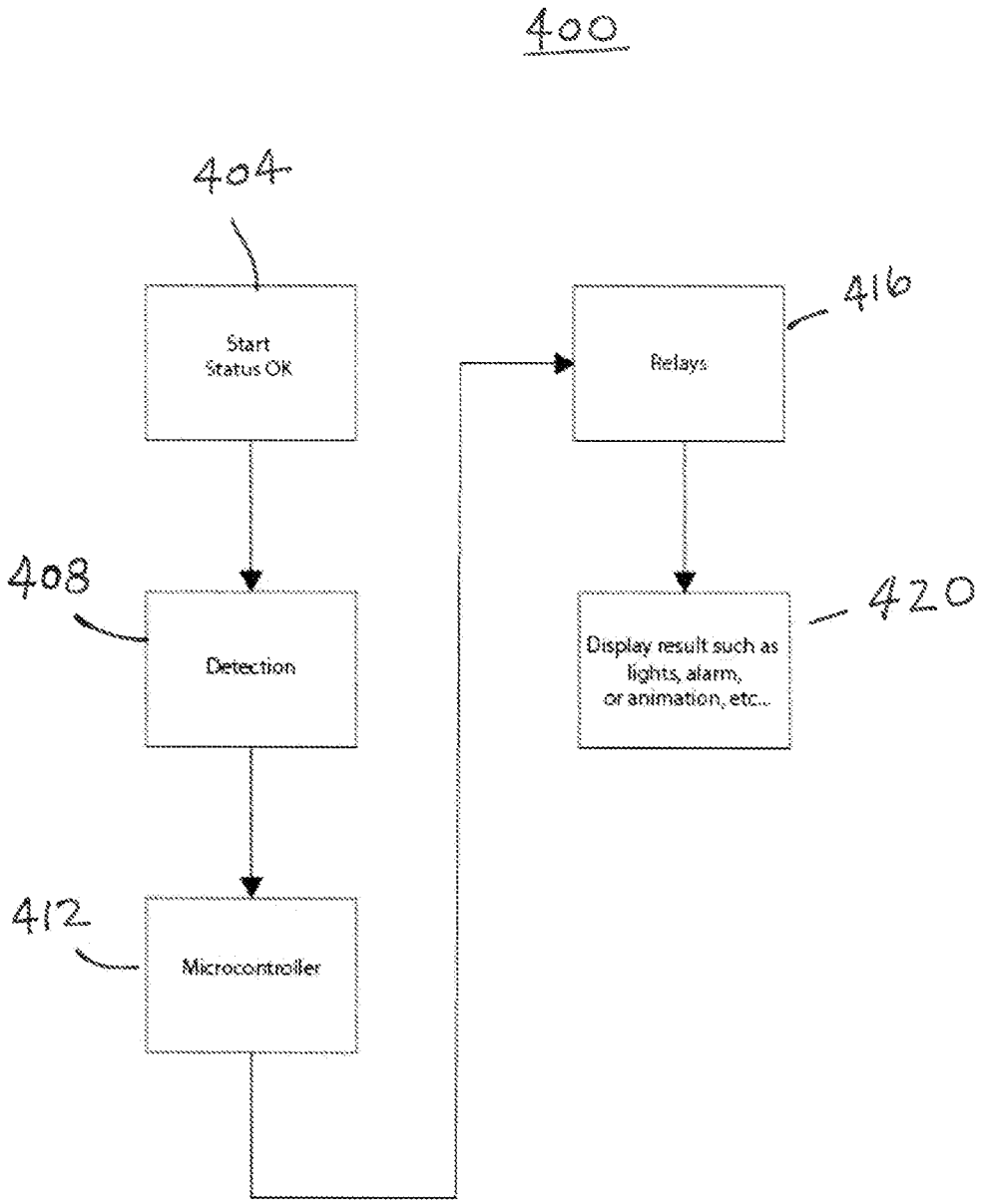
FIG. 4 is a flowchart depicting one embodiment of a method for detecting the distance between passengers entering the escalator of FIG. 1.

Referring to FIG. 4, a flowchart illustrating one embodiment of process 400, which represents a basic operation of control system 10. In some embodiments, process 400 can start at step 404 when system 10 has been turned on and is ready to operate. Process 400 can then proceed to detection step 408, which can occur when a passenger passes by a motion detector, as described above. When a passenger does passes by the motion detector, the event is notified to a microcontroller at step 412. Process 400 can then proceed to step 416 where the microcontroller can send electrical signals to one or more relays that can operate the audible and visuals alarms, as described above, at step 420.

Figure 5:
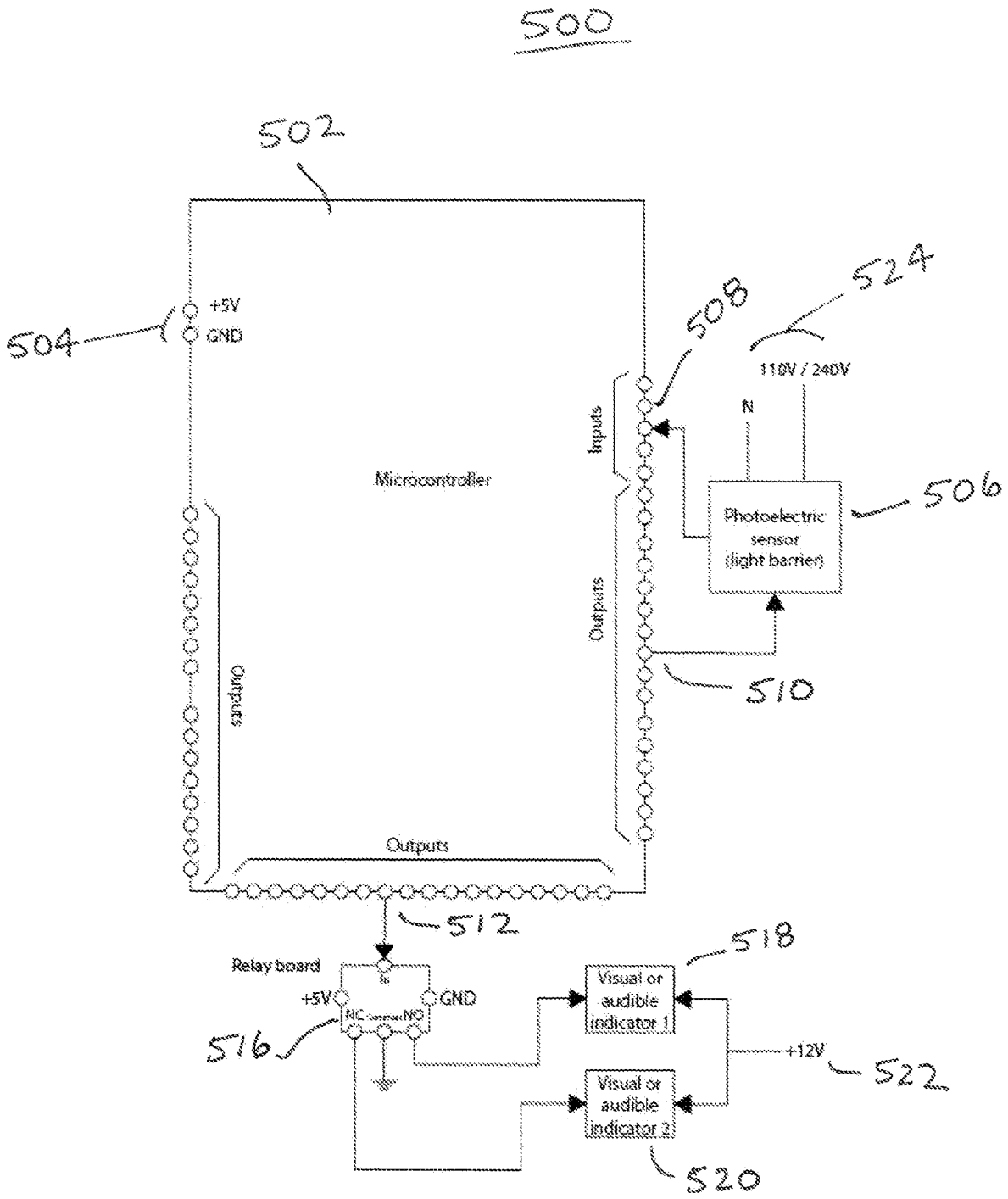
FIG. 5 is a block diagram schematic depicting one embodiment of the system for detecting the distance between passengers entering the escalator of FIG. 1.

Referring to FIG. 5, a block diagram is shown of one embodiment of control system 10. In some embodiments, control system 10 can comprise of microcontroller 502, which can comprise a model ATMega 2560 microcontroller as manufactured by Microchip Technology Inc. of Chandler, Ariz., USA, which can be powered by a +5 volt dc power supply at terminals 504.

In some embodiments, system 10 can comprise of photoelectric sensor 506 operatively coupled to microcontroller 502. Sensor 506, as shown in FIG. 5, can be used as motion detector 18, 24 or 26 as described and shown in FIGS. 2 and 3. In some embodiments, sensor 506 can be powered by 120V or 240V AC mains power 524. In some embodiments, microcontroller 502 can send an activation signal to sensor 506 from output terminal 510 to enable or disable sensor 506. In some embodiments, sensor 506 can provide an output signal to input terminal 508 of microcontroller 502 wherein the output signal indicates when a person walks past sensor 506 to trigger its operation. In some embodiments, microcontroller 502 can output a control signal to relay board 516 from output terminal 512, wherein the control signal causes relay board 516 to operate either or both indicators 518 and 520, which can be powered by 12 volts DC power 522. Either or both of indicators 518 and 520 can provide an audible and visual indicator and can be used as indicators 20 and 28 as described above and shown in FIGS. 2 and 3.

Figure 6:
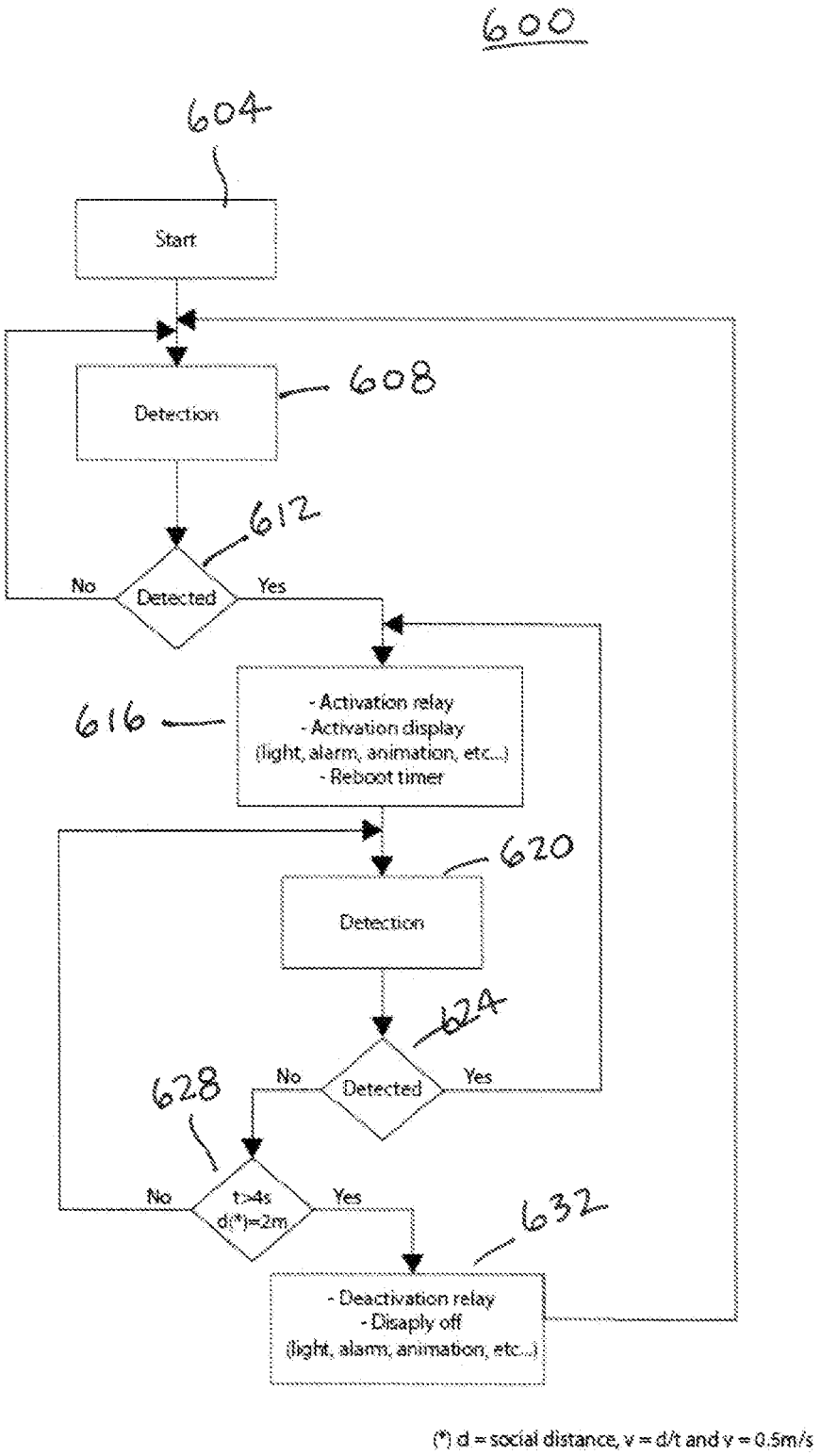
FIG. 6 is a flowchart depicting one embodiment of a method carried out by the system of FIG. 5.

Referring to FIG. 6, a flowchart is shown representing one embodiment of process 600 that can be carried out by microcontroller 502 wherein the process can be embodied in a software application comprising software code segments comprising commands for microcontroller 502 to carry out process 600.

In some embodiments, process 600 can start and initialize microcontroller 502 at step 604, whereupon process 600 waits for a first detection event, namely, a first person walking past a motion detector such as detector 24 shown in FIG. 3, at step 608. At decision step 612, process 600 can determine if a first detection event occurred. If a first detection event has not occurred, process 600 returns to step 608 to wait for one. If a first detection event has occurred, the process 600 can then activate one or both of an audible and visual indicator at step 616. Process 600 can then determine if a second detection event has occurred, namely, a second person walking past a motion detector such as detector 24 shown in FIG. 3, at step 620.

At decision step 624, process 600 can determine if a second detection event occurred. If a second detection event has not occurred, process 600 can then determine at step 628 whether a predetermined period of time has passed that would be sufficient for the first person to travel at least 2 metres from the motion detector, for example, has 4 seconds passed if the escalator travels at 0.5 metres/second. If the predetermined period of time has not fully passed at step 628, then process 600 can revert back to step 620. If the predetermined period of time has passed at step 628, process 600 can proceed to step 632 whereupon any activated indicators can be deactivated. Process 600 can then revert back to step 608.

The various illustrative logical blocks, modules, circuits, and algorithm steps described in connection with the embodiments disclosed herein can be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans can implement the described functionality in varying ways for each particular application, but such implementation decisions should not be interpreted as causing a departure from the scope of the embodiments described herein.

Embodiments implemented in computer software can be implemented in software, firmware, middleware, microcode, hardware description languages, or any combination thereof. A code segment or machine-executable instructions can represent a procedure, a function, a subprogram, a program, a routine, a subroutine, a module, a software package, a class, or any combination of instructions, data structures, or program statements. A code segment can be coupled to another code segment or a hardware circuit by passing and/or receiving information, data, arguments, parameters, or memory contents. Information, arguments, parameters, data, etc. can be passed, forwarded, or transmitted via any suitable means including memory sharing, message passing, token passing, network transmission, etc.

The actual software code or specialized control hardware used to implement these systems and methods is not limiting of the embodiments described herein. Thus, the operation and behavior of the systems and methods were described without reference to the specific software code being understood that software and control hardware can be designed to implement the systems and methods based on the description herein.

When implemented in software, the functions can be stored as one or more instructions or code on a non-transitory computer-readable or processor-readable storage medium. The steps of a method or algorithm disclosed herein can be embodied in a processor-executable software module, which can reside on a computer-readable or processor-readable storage medium. A non-transitory computer-readable or processor-readable media includes both computer storage media and tangible storage media that facilitate transfer of a computer program from one place to another. A non-transitory processor-readable storage media can be any available media that can be accessed by a computer. By way of example, and not limitation, such non-transitory processor-readable media can comprise RAM, ROM, EEPROM, CD-ROM or other optical disk storage, magnetic disk storage or other magnetic storage devices, or any other tangible storage medium that can be used to store desired program code in the form of instructions or data structures and that can be accessed by a computer or processor. Disk and disc, as used herein, include compact disc (CD), laser disc, optical disc, digital versatile disc (DVD), floppy disk, and Blu-ray disc where disks usually reproduce data magnetically, while discs reproduce data optically with lasers. Combinations of the above should also be included within the scope of computer-readable media. Additionally, the operations of a method or algorithm can reside as one or any combination or set of codes and/or instructions on a non-transitory processor-readable medium and/or computer-readable medium, which can be incorporated into a computer program product.

Although a few embodiments have been shown and described, it will be appreciated by those skilled in the art that various changes and modifications can be made to these embodiments without changing or departing from their scope, intent or functionality. The terms and expressions used in the preceding specification have been used herein as terms of description and not of limitation, and there is no intention in the use of such terms and expressions of excluding equivalents of the features shown and described or portions thereof, it being recognized that the invention is defined and limited only by the claims that follow.

We claim:

1. A method for ensuring social distancing on an escalator or travellator between a first passenger and a second passenger, the method comprising:

a) detecting when the first passenger passes by a first motion detector disposed at an entrance of the escalator or travellator;

b) calculating a time period it takes the first passenger to travel a predetermined distance required for social distancing on the escalator or travellator based on a velocity the escalator or travellator operates at, wherein the time period starts when the first passenger passes by the first motion detector;

c) detecting when the second passenger passes by the first motion detector; and d) alerting the second passenger to stop and wait if the second passenger passes by the first motion detector before the time period expires.

2. The method as set forth in claim 1, further comprising alerting the second passenger with one or both of an audible alarm and a visual alarm.

3. The method as set forth in claim 1, further comprising alerting the second passenger when it is safe to proceed onto the escalator or travellator.

4. The method as set forth in claim 1, further comprising alerting the second passenger when the first passenger is at least the predetermined distance required for social distancing away from the second passenger.

5. The method as set forth in claim 1, further comprising alerting the first passenger when it is safe to proceed onto the escalator or travellator.

6. The method as set forth in claim 1, further comprising:

a) detecting when the first passenger passes by a second motion detector, wherein the second motion detector is disposed from the first motion detector by at least the predetermined distance required for social distancing; and b) alerting the second passenger to stop and wait if the second passenger passes by the first motion detector before the first passenger passes by the second motion detector.

7. The method as set forth in claim 6, wherein the step of alerting the second passenger comprises alerting the second passenger with one or both of an audible alarm and a visual alarm.

8. The method as set forth in claim 6, further comprising alerting the second passenger when it is safe to proceed onto the escalator or travellator.

9. The method as set forth in claim 6, further comprising alerting the second passenger when the first passenger is at least the predetermined distance required for social distancing away from the second passenger.

10. The method as set forth in claim 6, further comprising alerting the first passenger when it is safe to proceed onto the escalator or travellator.

11. A system for ensuring social distancing on an escalator or travellator between a first passenger and a second passenger, the system comprising:

a) means for detecting when the first passenger passes by a first motion detector disposed at an entrance of the escalator or travellator;

b) means for calculating a time period it takes the first passenger to travel a predetermined distance required for social distancing on the escalator or travellator based on a velocity the escalator or travellator operates at, wherein the time period starts when the first passenger passes by the first motion detector;

c) means for detecting when the second passenger passes by the first motion detector; and d) means for alerting the second passenger if the second passenger passes by the first motion detector before the time period expires.

12. The system as set forth in claim 11, further comprising means for alerting the second passenger with one or both of an audible alarm and a visual alarm.

13. The system as set forth in claim 11, further comprising means for alerting the second passenger when it is safe to proceed onto the escalator or travellator.

14. The system as set forth in claim 11, further comprising means for alerting the second passenger when the first passenger is at least the predetermined distance required for social distancing away from the second passenger.

15. The system as set forth in claim 11, further comprising means for alerting the first passenger when it is safe to proceed onto the escalator or travellator.

16. The system as set forth in claim 11, further comprising:

a) means for detecting when the first passenger passes by a second motion detector, wherein the second motion detector is disposed from the first motion detector by at least the predetermined distance required for social distancing; and b) means for alerting the second passenger to stop and wait if the second passenger passes by the first motion detector before the first passenger passes by the second motion detector.

17. The system as set forth in claim 16, further comprising means for alerting the second passenger with one or both of an audible alarm and a visual alarm.

18. The system as set forth in claim 16, further comprising means for alerting the second passenger when it is safe to proceed onto the escalator or travellator.

19. The system as set forth in claim 16, further comprising means for alerting the second passenger when the first passenger is at least the predetermined distance required for social distancing away from the second passenger.

20. The system as set forth in claim 16, further comprising means for alerting the first passenger when it is safe to proceed onto the escalator or travellator.

* * * * *